US007845501B1

(12) United States Patent
Fosburg et al.

(10) Patent No.: US 7,845,501 B1
(45) Date of Patent: Dec. 7, 2010

(54) MOUNTABLE PEGBOARD DEVICE FOR ROLLING TOOL ADAPTER

(75) Inventors: Gary L Fosburg, Grass Valley, CA (US); Mark A. Fisher, Grass Valley, CA (US)

(73) Assignee: GMF Labs, Grass Valley, CA (US)

( * ) Notice: Subject to any disclaimer, the term of this patent is extended or adjusted under 35 U.S.C. 154(b) by 412 days.

(21) Appl. No.: 11/715,191

(22) Filed: Mar. 7, 2007

(51) Int. Cl.
*A47H 1/00* (2006.01)

(52) U.S. Cl. ..... 211/103; 211/70.6; 312/280

(58) Field of Classification Search ..... 211/70.6, 211/86.01, 117, 87.01, 103, 119.004, 175, 211/207, 208, 54.1, 59.1, 189; 248/447.1, 248/447.2, 450, 451, 323, 327, 339, 340, 248/466, 489, 494, 495, 496, 497, 211, 241, 248/342; 108/144.11; D6/300; 312/280
See application file for complete search history.

(56) References Cited

U.S. PATENT DOCUMENTS

| | | | | | |
|---|---|---|---|---|---|
| 1,357,280 | A | * | 11/1920 | Dulle | 248/490 |
| 1,380,747 | A | * | 6/1921 | Stanford et al. | 211/1 |
| 2,102,977 | A | * | 12/1937 | Shoemaker et al. | 248/222.41 |
| 2,954,874 | A | * | 10/1960 | Rouse | 211/85.9 |
| 3,204,776 | A | * | 9/1965 | Brown et al. | 211/70.6 |
| 3,294,353 | A | * | 12/1966 | Rowe | 248/346.01 |
| 3,370,822 | A | * | 2/1968 | Miller | 248/476 |
| 3,926,419 | A | * | 12/1975 | Kenny | 269/16 |
| 4,026,415 | A | * | 5/1977 | Sarley | 211/4 |
| 4,165,088 | A | * | 8/1979 | Nelson | 280/47.35 |
| D268,238 | S | * | 3/1983 | Brescia et al. | D6/300 |
| 4,531,645 | A | * | 7/1985 | Tisbo et al. | 211/131.1 |
| 4,852,930 | A | * | 8/1989 | Agee | 294/143 |
| D343,520 | S | * | 1/1994 | Machugh | D6/300 |
| 5,566,844 | A | * | 10/1996 | Bernardin | 211/189 |
| D378,251 | S | * | 3/1997 | Levin | D6/300 |
| 5,746,330 | A | * | 5/1998 | DiBetta | 211/70.6 |
| 5,785,187 | A | * | 7/1998 | Lipman et al. | 211/59.1 |
| 6,202,865 | B1 | * | 3/2001 | Kuo | 211/70.6 |
| 6,264,220 | B1 | * | 7/2001 | Pierce et al. | 280/79.3 |
| 6,591,995 | B1 | * | 7/2003 | Grove | 211/87.01 |
| 6,808,077 | B2 | * | 10/2004 | McConnell | 211/70.6 |
| 7,080,733 | B2 | * | 7/2006 | Kao | 206/372 |
| 2005/0145769 | A1 | * | 7/2005 | Ives et al. | 248/447.1 |

FOREIGN PATENT DOCUMENTS

| | | | | |
|---|---|---|---|---|
| GB | 2263440 | A | * | 7/1993 |

* cited by examiner

*Primary Examiner*—Darnell M Jayne
*Assistant Examiner*—Stanton L Krycinski
(74) *Attorney, Agent, or Firm*—Mark C. Jacobs

(57) ABSTRACT

A device to be mounted permanently or removably to the side wall of a rolling tool cart for the carrying of tools and other shop paraphernalia such as extension cords, solder rolls, masking tape, and hand tools. The device has a peripheral rectangular frame of four framing segments, which frame is integrated with and surrounds a forwardly raised portion with an inclined surround interposed there between. The panel has a series of rows and columns with ⅓-inch spaced bores for the conventional mounting of tools and other shop items. The top of the frame has a flange that fit over a lip of a rolling tool cart. Two legs, vertically adjustably mounted outside of the central portion on the side framing, each have a bottom flange to engage a downward depending edge of a tool cart side wall.

10 Claims, 3 Drawing Sheets

MOUNTABLE PEGBOARD DEVICE FOR ROLLING TOOL ADAPTER

FIELD OF THE INVENTION

This application pertains to a device to be mounted to a mechanic's rolling tool cart.

BACKGROUND OF THE INVENTION

Many mechanics in various trades use or have their own rolling tool cart. These carts have anywhere from three to six drawers in a lower section, and often the lower portion of the cart has a toolbox sized upper portion that may have a plurality of shallower drawers as an upper portion. Mechanics, such as those in the automotive repair industry, the assembly of articles, boat repair and maintenance, utilize rolling carts for the storage of their personal tools among other things used in the shop.

Now homeowners who want these professional carts can obtain them from Sears, Home Depot, and other similar stores. These carts are essentially a rolling bureau. They have a plurality of drawers mounted in a cabinet frame on large casters. See Sears tool catalog which features these apparatuses, usually in a red color. These rolling carts usually have smooth sides to which magnets will stick. Instruction sheets, calendars, personal photos can be attached to the sides or side walls of such carts. If not, the side walls go unused.

Professional mechanics in various industries usually use air-operated (pneumatic) tools. These tools be they air-operated or electric are usually stored in generally lockable drawers. But the corollary is that while safety is gained by storing tools in drawers, ofttimes convenience is lost due to the inability to locate the specific tool at the point in time when needed.

The invention accordingly comprises the device possessing the features, properties, the selection of components which are amplified in the following detailed disclosure, and the scope of the application of which will be indicated in the appended claims.

KNOWN PRIOR ART

While no actual formal search was run, applicant is aware of the following U.S. Patents:

| | | |
|---|---|---|
| 1. Massey | 5,180,128 | Jan. 19, 1993 |
| 2. Gibbons | 4,405,110 | Sep. 20, 1983 |
| 3. .Laskowski | 6,061,909 | May 16, 2000 |

BRIEF SUMMARY OF THE INVENTION

A device to be mounted to the side wall of a rolling or rollaway tool cart, which device serves the same function as a pegboard mounted to a wall. Tools, accessories, wire, lights, and other shop useful items can be attached to the pegboard and be accessible anytime the user is utilizing the tool cart.

It is a first object to provide a lowcost device to store air-operated and other tools.

It is a second object to provide a device that permits quick storage and release of a multiplicity of air-operated tools in a defined space.

It is a third object to provide a storage device that can be mounted on a tool cart to provide vertical storage for a multiplicity of shop useful items.

It is a fourth object to provide a device that can be accessed quickly and easily by any user.

It is a fifth object to provide a device that can be color matched to the toolbox to which it is to be attached.

Other objects of the invention will in part be obvious and will in part appear hereinafter. For a fuller understanding of the nature and objects of the invention, reference should be made to the following detailed description, taken in conjunction with the accompanying drawings.

DESCRIPTION OF THE PREFERRED EMBODIMENT

Figure 1:
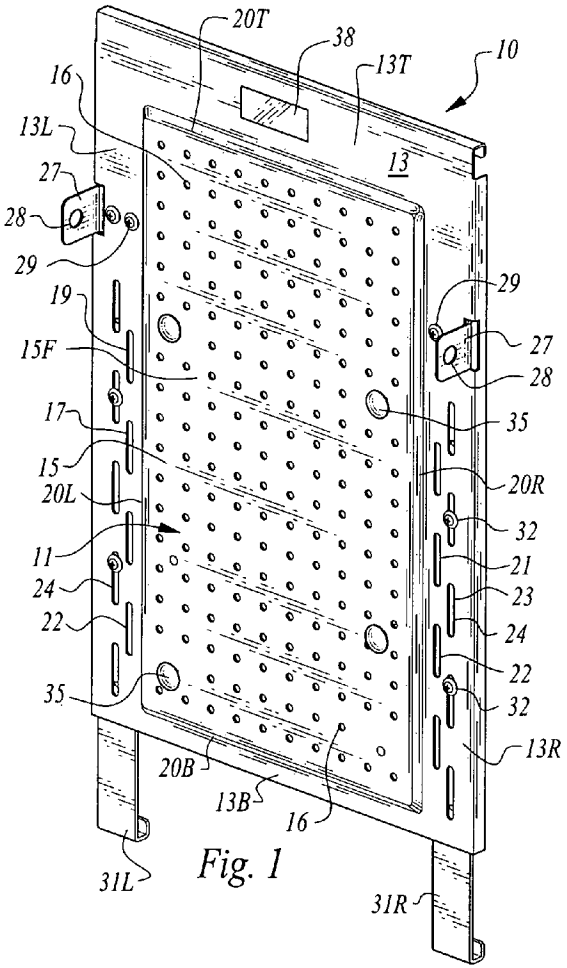
FIG. 1 is a front perspective view of the device of this invention.

The discussion begins with FIG. 1, a front perspective view of the device of this invention. The device 10 has a frame 12 integrated with a central raised portion 15 that is forwardly disposed. Device 10 comprises a main panel 11 consisting of a central portion 15 surrounded by a frame 12, which frame has a plurality of integrated framing segments, 13, which surround said central raised portion, 15. The panel 11 has a pair of spaced legs 31L & 31R attached to the two side framing members 13L & 13R respectively, preferably on the rear surface thereof.

Panel 11 has an integrated surround 20 of four inclined sections 20T,20L,20B and 20R, inclined at between 30 and 45 degrees as may be desired, that are interposed between the framing segments 13 and the raised central portion 15. The frame 12 includes a top section 13T, a pair of spaced side sections 13L & 13R and a bottom section 13B, which is of a smaller elevation than the top section. The two side sections or segments, 13L & 13R however, are preferably of the same lateral extension.

The top section 13T is not bored out in the embodiment as shown, but could be if desired. A company decal or sticker 38 is shown at a convenient location to identify the source of the product. Each of the two side framing sections 13R and 13L include a series of spaced slots set in two vertical rows; the inner rows being 19 & 21 and the outer rows being 17 & 23 with vertical spacing between adjacent slots as well. Individual slots are designated 22 for those situated on an inner row, while those on an outer row are designated 24. Mount screws 32 disposed through individual slots 22 & 24 are for longitudinal and lateral adjustable attachment of the legs 31R & L as seen in FIG. 1. Other mount screws 29 are seen to be present for the attachment of a hasp a.k.a. L-shaped member 27.

The central raised portion has a front surface 15F. The central portion includes rows and columns of through bores, generally of about ¼-inch diameter for the mounting of tools and other shop paraphernalia. A series of strategically but randomly placed mount mushroom buttons 35 are shown disposed though arbitrary bores 16 on the raised portion 15F. These mushrooms can be mounted anywhere on the central raised portion. They are called mushrooms because they have a recessed neck area, and resemble a mushroom. A technical name often associated with them is "coach bolts". Thus the terms can be used interchangeably. These possess a pressed-fit insert with threads, and are designed to handle the weight of items hung on them. Coach bolts are readily available in the marketplace.

A pair of spaced hasps, 27, that are L-shaped and each of which has a forward section with a bore 28 therein. This section projects forwardly through an oversize vertical edge slot 25, both of which are at the same elevation, and both of which are at opposite edges of the main panel. The rear section 27R of 27 lies parallel to the side frame and is attached thereto by two mounting screws, 29. See FIG. 3. A plurality of mushroom mount buttons 35 are seen arbitrarily disposed through bores 16 of the front 15F of the central portion. These coach bolts 35 can be utilized for retention of 50 ft. retractable air hoses or 40 ft. retractable electrical cords available from vendors such as Astro Tools. Such hoses and electrical cords have a "U" bracket that hooks over the coach bolt for ready storage and availability without the need for any hand tools.

Figure 2:
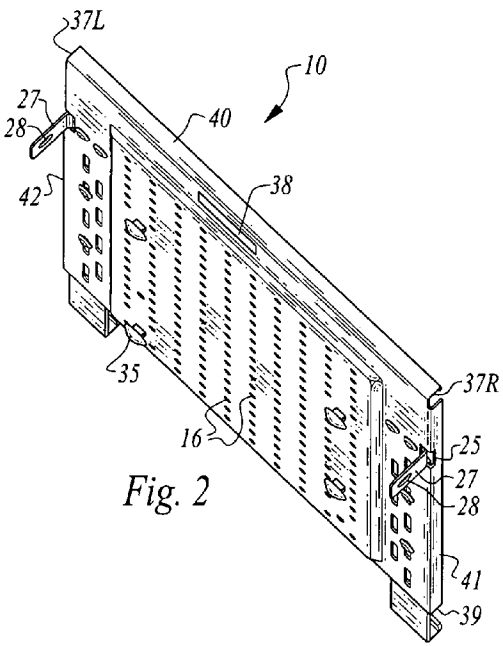
FIG. 2 is a top perspective view thereof.

Reference is now made to FIG. 2. As can be seen, the sides of the two framing members, 13R and 13L of the main panel, 11, are not flat, but rather curl around and terminate in mirror image normally disposed edges, 41 for the right and 42 for the left side. These edges or flanges 41, 42 commence spaced down from the upper edge of the top framing section 13T, the elevation difference being a notch 37L and 37R, with only the right notch being visible in this view. The rearward extension of these two flanges is about ½ inch, and serve to act as a standoff as well as imparting strength to the panel.

The top framing section 13T of the main panel also has a rearwardly directed flange 40 which has a first portion of a depth slightly greater than the depth of the side area flanges, and a second downwardly depending section also of about ½-inch. This tilted-L shaped flange also serves as standoff. The space between the flange and the main panel is designated 39. The bottom area 13B has no flange. As will be discussed, this space 39 can serve as mounting means. See infra.

Figure 3:
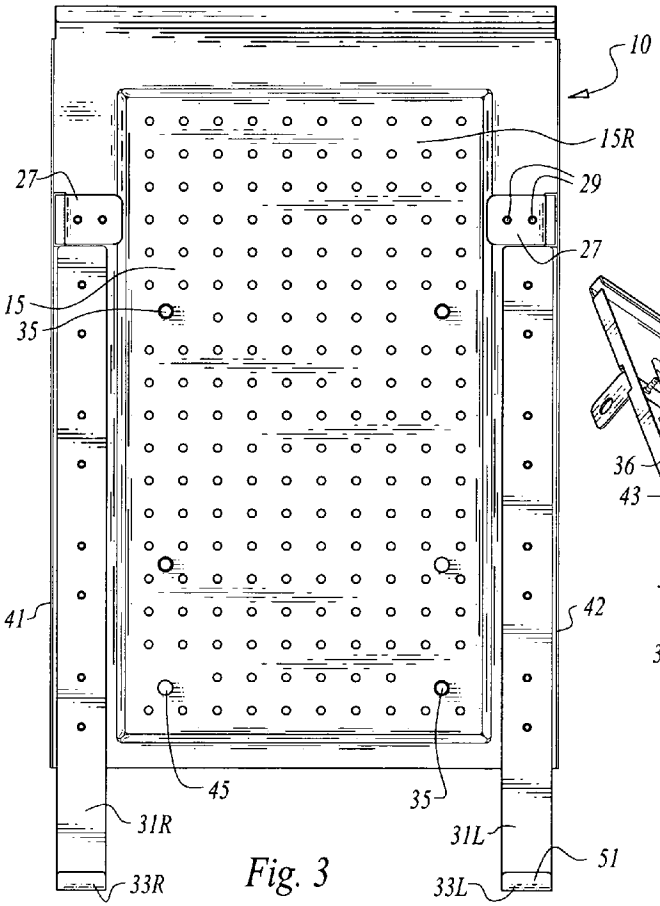
FIG. 3 is a rear elevational view of this device.

The reader is now requested to visit FIG. 3, a rear elevational view. The rear of the L-member 27 which is disposed parallel to the main panel's rear surface designated 15R is shown extending through the respective vertical slot 25 with the two mounting bolts of the self-tapping type, since no nuts are present though they could be. The leg pair of elongated planar members 31R and 31L each have a tilted L flange at the bottom thereof designated 33L & 33R respectively. The rearward depth of the flanges 33L & R on the legs are equal to the rearward depth of the top flange of the main panel in order to ensure that the device 10 rests evenly, flat against any surface such as of a rollaway toolbox. The gap between the flange and main panel is designated 51. The side flanges are seen therefore to be present only to add strength and to prevent torquing of the panel. Each leg is laterally sized to easily fit between the rearward side flange 41, or 42 and the surface of the, here recessed, central portion 15. That is, the legs each have a lateral extension slightly less than the lateral extension of the side framing members 13L & 13R. See FIG. 3.

On the, here recessed central portion, since this is rear view, one can see the threads of the various mushroom mount buttons disposed in bores 16. These mounts are referred to coach bolts and also as was mentioned supra, as mushrooms because they have a recessed neck and thus resemble a mushroom. On the neck a cord can be hung, or the mushroom can serve as a hook for certain tools and other shop objects such as a roll of masking tape or retractable air/electric hose reels.

Figure 4:
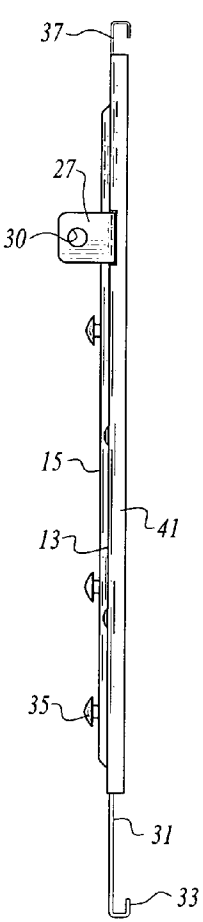
FIG. 4 is a right side elevational view of this device.

FIG. 4 is a right side elevational view with the left side being a mirror image. A portion of the forward extending L-member 27 with its large bore 30 is seen. The notch 37 at the top of the flange can also be seen. The notch serves no special function other than to separate the top fold,—flange—from the side flange.

Figure 5:
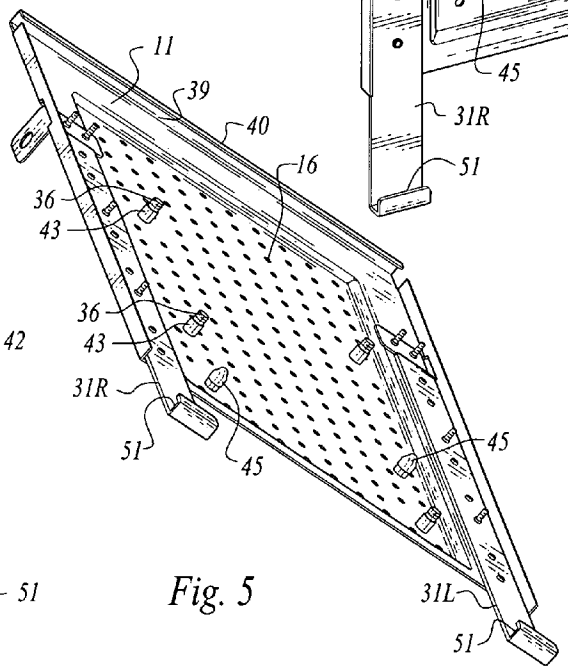
FIG. 5 is a bottom rear perspective view of this invention.

FIG. 5 is a bottom perspective view of this device. Here one can note how the tilted L flange of each leg, is of the same depth as the flange at the top of the device and each is also rearwardly directed. One can also observe several circular built-up areas 43, around several of the bores 16 and specifically those wherein mushroom mounts have been inserted. These built-up areas 43 are internally threaded thus negating the need for a nut on the rear of the mushroom mount 35. The space 39 between the flange 40 and the main panel 11 can also be seen.

Figure 6:
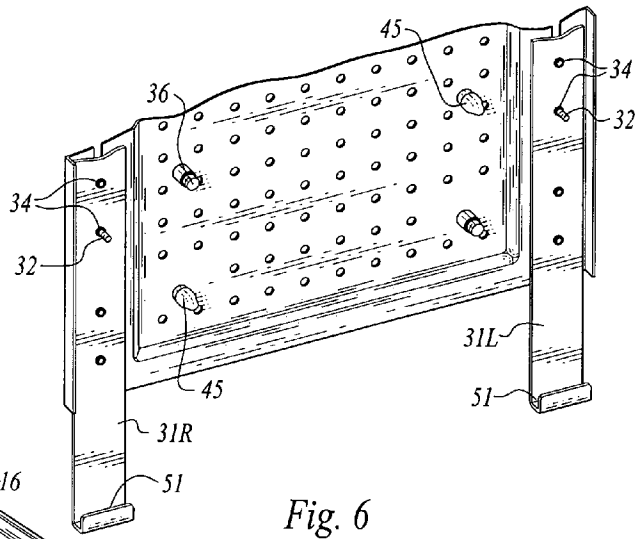
FIG. 6 is a closeup view of the lower front of this device.

FIG. 6 is a closeup view of a portion of the rear surface of the device 10. One can see that several threads 36 of mushroom mounts 35 and one cap or cover 45, at the lower left. Several of the built-up threaded bores 34 for the attachment of the legs 31 to the panel can also be seen. The legs can be adjusted up or down as may be desired prior to attachment by proper placement of the bolts that retain to the respective leg to the framing between the central raised portion and the edge of the respective side frame section. The gap 51 is seen to be the same depth as gap (space) 39 to ensure that the device lies flat against the rollaway tool cart.

Figure 7:
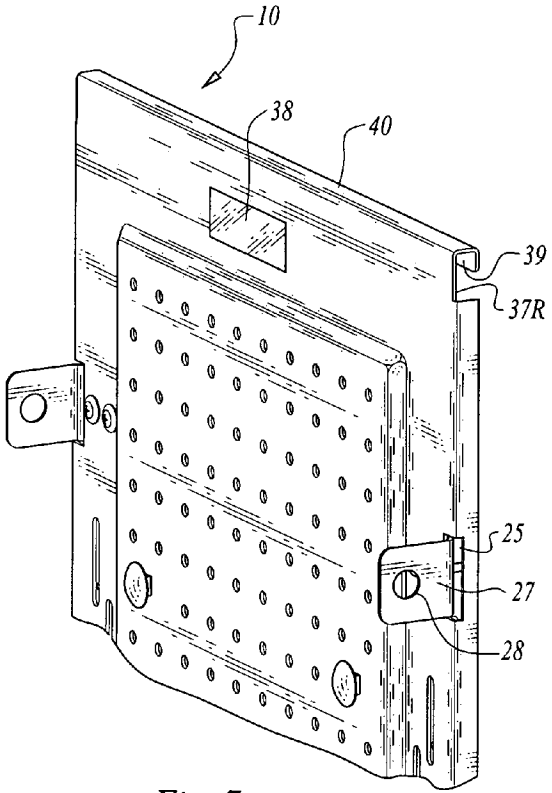
FIG. 7 is a closeup view of the upper right corner of this device.

In FIG. 7, the gap 39 beneath flange 40, as well as the side wall notch 37R can also be seen in this top closeup perspective view.

Figure 8:
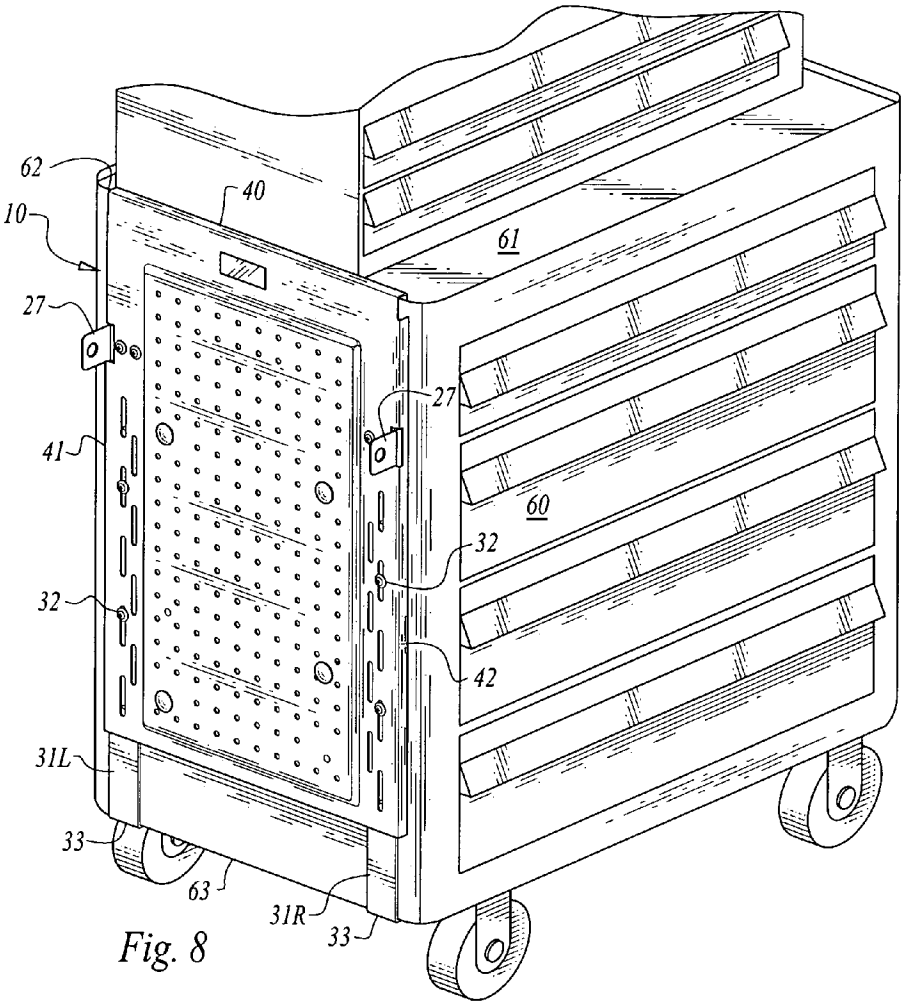
FIG. 8 is a perspective view of this device mounted on a rolling tool cart.

FIG. 8 is a perspective view that permits the reader to view the unit 10, removably installed on a tool cart. Previously it has been stated that the top flange 40 and tilted L flanges 33 act as standoffs to space the panel from the side wall of the tool cart. But they also attach to the cart and when the legs are tightened into position, the device 10 becomes attached and secure upon the cart 60. See further discussion infra.

For a permanent mounting, it would be necessary to screw the device 10 to the cart body, through any of the existing bores in the central portion, a task which would require drilling aligned holes into the side wall of the cart. But if someone wants a permanent mounting of the device to the cart, this is the way to go. The device can also be mounted upon a door or other vertical flat surface if desired, but such is not the prime intended purpose of this device.

The FIG. 8 view depicts an alternate and preferred mounting means that does NOT require drilling into the cart body, and as such is a removable mounting mode. Here the rolling cart 60 which like many carts, has an upper and a lower portion. The lower portion has a lower top surface 61 with spaced side raised lip 62 on each side. The mode of removable mounting entails placing the upper top edge 40 of device 10 over the raised lip 62, after the two legs 31L and 31R have been extended slightly below the bottom edge 63 of the cart. The two legs are then raised and the mounting bolts 32 tightened. The side walls 41,42, then act as the standoffs to space the device 10 away from the side of the cart 60. Thus, items can be easily hung on the pegboard device in a conventional manner, using conventional pegboard mounts such as for screwdrivers, wrenches, hammers and other tools. These pegboard mounts can be purchased at any hardware or big box home improvement store.

While the mounting in FIG. 8 is to the left side of the cart, obviously the device can be mounted on the right side as well. If a cart has no upper portion, or if the upper portion is recessed forwardly and a lip is present in the rear, then the nonpermanent mounting can take place on the rear of the cart as well. Permanent mounting capability to the rear of the cart may depend upon the ability to rotate the cart at its intended location to gain access to the rear of the cart.

MOUNTING INSTRUCTIONS

As noted earlier, the device of this invention is intended to be mounted on the side or perhaps the back or front of a rolling a.k.a. rollaway tool cart. The actual construction of the cart is the limiting factor. An upward extending lip is needed on the cart for the device to be properly mounted. Steps one and two can be done in either order. If step one is carried out first, there will be no need to physically hold the device while inserting the two mounting brackets 31. Thus the first step remains to hang the device 10 by its top lip 62 over the upstanding edge of the cart 60. The pegboard is now being retained solely by the cart 60. Slide the two mounting brackets 31 one at a time on the rear side of the device, adjacent the respective side edges, and raise the mounting brackets to the appropriate height where they will engage the lower edge of the side wall or other wall to which the device 10 is being attached. When and as the bottom edge of the bracket engages the lower edge of the wall of the cart, place at least two bolts 32 through the slots and into the aligned holes of the mount bracket, and threadingly engage the holes 34 of the mounting brackets 31 after disposing the conventional finishing washer and plastic washer on the bolt 32. Then attach the pair of universal rollaway air couplers, the L-shaped members designated 27, using conventional bolts and washers. These L-shaped members, provide a safety factor, in that they prevent the mounting brackets from sliding upwardly inadvertently, should they slip out from under the bottom lip of the cart 60.

Previously reference has been made to the mushroom mounts 35, which are also known in the art as coach bolts 35. These mounts 35 have a press fit insert with threads thereon, in order to sustain the weight load to be placed upon them. These may be used for the attachment of retractable air hoses, retractable electrical cords, and other useful items that mechanics may want to attach to the device of this invention. These retractable accessories are available in the marketplace from applicant's assignee and other third parties. These accessories include an unseen U-bracket that engages the shaft 43 of the mushroom mount 35, without the need for tools.

The device may be obtained in various powder coated colors on steel, or in polycarbonate, though black and tool cart red are the most desired for color coordination.

Attachment of items to the panel 1 in addition to being by conventional pegboard attachments which are readily available, such as for a plurality of hand-operated screwdrivers, or hammers among other hand tools, there are a variety of special mounts for drills, power screwdrivers, etc., available in the marketplace.

It is seen that I have developed a device that can be removably or permanently mounted to the side and perhaps to the rear of a rolling tool cart. The device has a frame integrated with a central raised portion that is forwardly disposed. A pair of legs of a lateral extension narrower than the framing segments at the sides of the central portion, are vertically extendible a preset amount to a fixable position. The top frame section, includes a flange to hook over an upstanding lip of a rolling car. Each leg also includes a flange which can engage the bottom lip of a tool cart if such bottom lip is present.

The device 10's panel 11 can be manufactured by stamping a sheet of steel or aluminum to raise the central portion and to add the bores, followed by metal pressing the side edges of the right and left framing segments. The leg slots can be cut in using conventional tools or by laser beam.

Plastic units of the main panel can be formed by injection molding. The device can be made using a plastic main panel with metal legs and vice versa.

Since certain changes may be made in the described device without departing from the scope of the invention herein involved, it is intended that all matter contained in the above description and shown in the accompanying drawings shall be interpreted as illustrative and not in a limiting sense.

We claim:

1. A device for the retention of tools and other objects, for removable or permanent mounting to a rolling tool cart, which device comprises:

a main panel comprising an integrated frame of four sections, top, bottom, a left and right side that surround a forwardly raised central portion, which central portion has a series of rows and columns of through bores for the mounting of tools thereto;

a pair of legs downwardly mounted, one on each of the respective side framing sections; and wherein said main panel has a top flange and each leg has a bottom flange, both leg flanges being directed rearwardly, and of the same depth; and wherein each side framing section has a left series and a right series of vertically disposed slots in two parallel columns for the attachment of a respective leg, and each leg has one column of spaced bores, each respective leg's column of bores being aligned with at least a part of a column of slots of a side framing section; and wherein said slots allow for longitudinal and lateral adjustment of said pair of legs when mounting said device to the rolling tool cart.

2. The device of claim 1 wherein each side framing section includes a forwardly disposed section of an L-shaped member, which L-shaped member includes a central bore therein.

3. The device of claim 1 wherein the main panel has a rearward normally disposed edge on each side of the panel.

4. The device of claim 1 wherein the two legs are vertically downwardly adjustable mounted.

5. The device of claim 1 wherein the device is made of steel and is powder coated in one of red and black.

6. A device to the retention of tools and other objects which device is adapted to be removable or permanently mounted to a rolling tool cart, which device comprises:

a main panel comprising an integrated frame of four sections, top, bottom, left and right that surround a forwardly raised central portion, which central portion has a series of rows and columns of through bores for the mounting of tools thereto;

a pair of vertically disposed legs mounted, one on each of the respective side framing sections, wherein each side framing section has a left series and a right series of vertically disposed slots in two parallel columns for the attachment of a respective leg, and each leg has one column of spaced bores, one column of slots being aligned with a least a part of a column of bores of a leg; and said main panel has a top flange and each leg has a bottom flange, both leg flanges being directed rearwardly, and of the same depth and the main panel has a rearward normally disposed edge on each side of the panel; and wherein said slots allow for longitudinal and lateral adjustment of said pair of legs when mounting said device to the rolling tool cart.

7. The device of claim 6 wherein each side framing section includes a L-shaped member having a forwardly disposed section of, which L-shaped member's forwardly disposed section includes a central bore therein, and the balance of the L-shaped member is attached to a side framing section.

8. The device of claim 7 wherein the device is made of steel that has been powder coated.

9. The device of claim 1 in combination with a series of coach bolts disposed randomly in the through bores of the central portion.

10. The device of claim 7 wherein an inclined wall is interposed between the framing sections is the raised central portion.

* * * * *